US008369731B2

(12) United States Patent
Yamamoto

(10) Patent No.: US 8,369,731 B2
(45) Date of Patent: Feb. 5, 2013

(54) IMAGE FORMING APPARATUS AND METHOD OF CHARGING USAGE FEE OF IMAGE FORMING APPARATUS

(75) Inventor: Kohji Yamamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 257 days.

(21) Appl. No.: 12/926,591

(22) Filed: Nov. 29, 2010

(65) Prior Publication Data

US 2011/0135336 A1 Jun. 9, 2011

(30) Foreign Application Priority Data

Dec. 4, 2009 (JP) ..... 2009-276259

(51) Int. Cl.
*G03G 21/02* (2006.01)

(52) U.S. Cl. ..... 399/79

(58) Field of Classification Search ..... 399/79, 399/80

See application file for complete search history.

(56) References Cited

U.S. PATENT DOCUMENTS

| | | | | |
|---|---|---|---|---|
| 2005/0024669 | A1* | 2/2005 | Aoki | 358/1.13 |
| 2008/0107440 | A1* | 5/2008 | Tsuzuki | 399/79 |
| 2010/0104300 | A1* | 4/2010 | Shinohara | 399/43 |
| 2011/0135337 | A1 | 6/2011 | Saito et al. | |

FOREIGN PATENT DOCUMENTS

| | | |
|---|---|---|
| JP | 2006-247988 | 9/2006 |
| JP | 2006-301016 | 11/2006 |
| JP | 2008-064896 | 3/2008 |
| JP | 2008-094045 | 4/2008 |
| JP | 2008-146615 | 6/2008 |

* cited by examiner

*Primary Examiner* — Walter L Lindsay, Jr.
*Assistant Examiner* — Frederick Wenderoth
(74) *Attorney, Agent, or Firm* — Harness, Dickey & Pierce, P.L.C.

(57) ABSTRACT

An image forming apparatus counts a number of sheets to be printed with a limited number of colorants or a limited amount of colorant using an other counter that is provided other than a color counter and a monochrome counter. The counter value of the other counter is adjusted using a weighting factor before being added to or subtracted from a counter value of the color counter or the monochrome counter.

9 Claims, 6 Drawing Sheets

FIG. 6

| PRINT SETTINGS INFORMATION | | | CHARGE FEE COUNTER | | |
|---|---|---|---|---|---|
| PRINT COLOR MODE | TONER SAVE MODE | ORIGINAL | COLOR COUNTER | MONOCHROME COUNTER | ECO COUNTER |
| COLOR MODE | ON | COLOR DATA | +1 | 0 | +1 |
| | | B/W DATA | 0 | +1 | 0 |
| | OFF | COLOR DATA | +1 | 0 | 0 |
| | | B/W DATA | 0 | +1 | 0 |
| MONOCHROME MODE | N/A | COLOR DATA | 0 | +1 | 0 |
| | | B/W DATA | 0 | +1 | 0 |

FIG. 7

| | COLOR COUNTER | MONOCHROME COUNTER | ECO COUNTER |
|---|---|---|---|
| PRINT ONE SET IN COLOR MODE | +10 | 0 | 0 |
| PRINT ONE SET IN MONOCHROME MODE | 0 | +10 | 0 |
| PRINT ONE SET IN COLOR AND TONER SAVE MODE | +10 | 0 | +10 |
| TOTAL | +20 | +10 | +10 |

FIG. 8

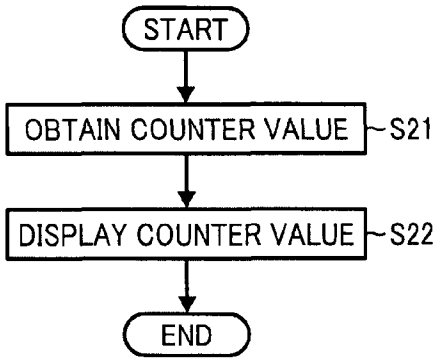

FIG. 11

| CHARGE FEE COUNTER DISPLAY MODE | CHARGE FEE DISPLAY COUNTER VALUE | |
|---|---|---|
| | COLOR COUNTER | MONOCHROME COUNTER |
| ECO COUNTER (COLOR UP DISPLAY MODE) | COLOR COUNTER + 0.5 × ECO COUNTER | MONOCHROME COUNTER |
| ECO COUNTER (MONOCHROME UP DISPLAY MODE) | COLOR COUNTER + ECO COUNTER | MONOCHROME COUNTER + ECO COUNTER |
| NORMAL COUNTER MODE | COLOR COUNTER | MONOCHROME COUNTER |

FIG. 12

| COLOR UP DISPLAY MODE | | MONOCHROME UP DISPLAY MODE | | NORMAL COUNTER MODE | |
|---|---|---|---|---|---|
| MONOCHROME | COLOR | MONOCHROME | COLOR | MONOCHROME | COLOR |
| 10 | 15 | 20 | 10 | 10 | 20 |

IMAGE FORMING APPARATUS AND METHOD OF CHARGING USAGE FEE OF IMAGE FORMING APPARATUS

CROSS-REFERENCE TO RELATED APPLICATIONS

This patent application is based on and claims priority under 35 U.S.C. §119 to Japanese Patent Application No. 2009-276259, filed on Dec. 4, 2009, in the Japanese Patent Office, the entire disclosure of which is hereby incorporated herein by reference.

FIELD OF THE INVENTION

The present invention generally relates to an image forming apparatus and a method of charging usage fee of the image forming apparatus.

BACKGROUND

The usage fee for using the image forming apparatus such as copier or printer is usually calculated based on a number of pages of document that are copied or printed and a unit charge fee that is previously set for copying or printing one page of document. More recently, as described in Japanese Patent Application Publication No. 2006-301016A, the usage fee for using the image forming apparatus is calculated based on a specific type of service provided by the image forming apparatus according to a user instruction. For example, Japanese Patent Application Publication No. 2006-301016A sets a unit charge fee respectively for full-color printing and monochrome printing such that the user is charged with higher fee for full-color printing.

In addition to full-color printing and monochrome printing, the recent image forming apparatus is provided with a function of printing a document using a limited number of colors, specifically, using more than one color but less than a number of colors used for full-color printing. In case of printing the document using the limited number of colors, the image forming apparatus described in Japanese Patent Application Publication No. 2006-301016A counts a number of pages of document copied or printed using a limited number of colors, either as a number of pages of document copied or printed in full-color or as a number of pages of document copied or printed in monochrome. Accordingly, the user may be charged with higher fee when the unit charge fee for full-color printing is used, while the user may be charged with lower fee when the unit charge fee for monochrome printing is used.

SUMMARY

In view of the above, there is a need for a technique of managing a charge fee for using an image forming apparatus even when a document is copied or printed using a printing mode other than the full-color printing mode or the monochrome printing mode.

In one example, an image forming apparatus counts a number of sheets to be printed with a limited number of colors of colorant or a limited amount of colorant using an other counter that is provided other than a color counter and a monochrome counter. The counter value of the other counter is adjusted using a weighting factor before being added to or subtracted from a counter value of the color counter or the monochrome counter.

Example embodiments of the present invention include an image forming apparatus including a color counter to count a number of sheets to be printed in a full-color printing mode to generate a first counter value, a monochrome counter to count a number of sheets to be printed in a monochrome printing mode to generate a second counter value, and an economical counter to count a number of sheets to be printed in an economical printing mode to generate a third counter value. The economical printing mode causes the image forming apparatus to form an image with colorant having a number of colors that is less than a number of colors used for the full-color printing mode or with colorant having an amount less than an amount of colorant used for a printing mode in which the economical printing mode is not set. The image forming apparatus further includes a counter processor to obtain selected one of: a total counter value of the color counter based on the first counter value and the third counter value; and a total counter value of the monochrome counter based on the second counter value and the third counter value. The counter processor obtains the total counter value of the color counter by multiplying the third counter value with a weighting factor to generate a weighted third counter value and subtracting the weighted third counter value from the first counter value. The total counter value of the color counter may be used for determination of a charge fee of the image forming apparatus based on a unit charge fee previously set for the full-color printing mode. The counter processor obtains the total counter value of the monochrome counter by multiplying the third counter value with a weighting factor to generate a weighted third counter value and adding the weighted third counter value to the second counter value. The total counter value of the monochrome counter being may be used for determination of a charge fee of the image forming apparatus based on a unit charge fee previously set for the monochrome printing mode.

Example embodiments of the present invention include a method of managing a charge fee of an image forming apparatus including: counting a number of sheets to be printed in a full-color printing mode using a color counter to generate a first counter value; counting a number of sheets to be printed in a monochrome printing mode using a monochrome counter to generate a second counter value; and counting a number of sheets to be printed in an economical printing mode to generate a third counter value. The economical printing mode causes the image forming apparatus to form an image with colorant having a number of colors that is less than a number of colors used for the full-color printing mode or with colorant having an amount less than an amount of colorant used for a printing mode in which the economical printing mode is not set. The method further includes obtaining selected one of a total counter value of the color counter based on the first counter value and the third counter value; and a total counter value of the monochrome counter based on the second counter value and the third counter value. The total counter value of the color counter is obtained by multiplying the third counter value with a weighting factor to generate a weighted third counter value and subtracting the weighted third counter value from the first counter value. The total counter value of the color counter may be used for determination of a charge fee of the image forming apparatus based on a unit charge fee previously set for the full-color printing mode. The total counter value of the monochrome counter is obtained by multiplying the third counter value with a weighting factor to generate a weighted third counter value and adding the weighted third counter value to the second counter value. The total counter value of the monochrome counter may be used for determination of a charge fee of the image forming apparatus based on a unit charge fee previously set for the monochrome printing mode.

In addition to the above-described example embodiments, the present invention may be practiced in various other ways, for example, as a recording medium storing a plurality of instructions which cause a processor to perform the above-described method of managing a charge fee of an image forming apparatus.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 6 is a table storing information indicating a counter value of each counter, which is incremented for printing one page of document in various printing modes using the image forming apparatus of FIG. 1;

FIG. 7 is a table storing information indicating a counter value of each counter, which is incremented for printing ten pages of document in various printing modes using the image forming apparatus of FIG. 1, according to an example embodiment of the present invention;

FIG. 8 is a flowchart illustrating operation of displaying a counter value of the image forming apparatus of FIG. 1;

FIG. 11 is a table storing information indicating calculation of a number of pages of document to be used for charge fee determination in various display modes, based on a counter value of at least one counter of the image forming apparatus of FIG. 1; and FIG. 12 is a table storing information indicating a counter value of the image forming apparatus of FIG. 1 for display in various display modes, each of which is obtained for printing ten pages of document in various printing modes using the image forming apparatus of FIG. 1.

Figure 1:
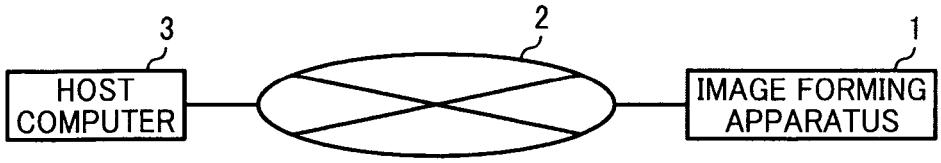
FIG. 1 is a schematic block diagram illustrating a configuration of an image forming system including an image forming apparatus, according to an example embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Referring to FIG. 1, an image forming system may be provided, which includes an image forming apparatus 1 that is connected to a host computer 3 through a network 2. The image forming apparatus 1 receives print data including print image data to be printed and print control data, which may be generated using the host computer 3, through the network 2 such as the Internet or a local area network to perform operation of printing an image of the print image data according to the print control data.

Figure 2:
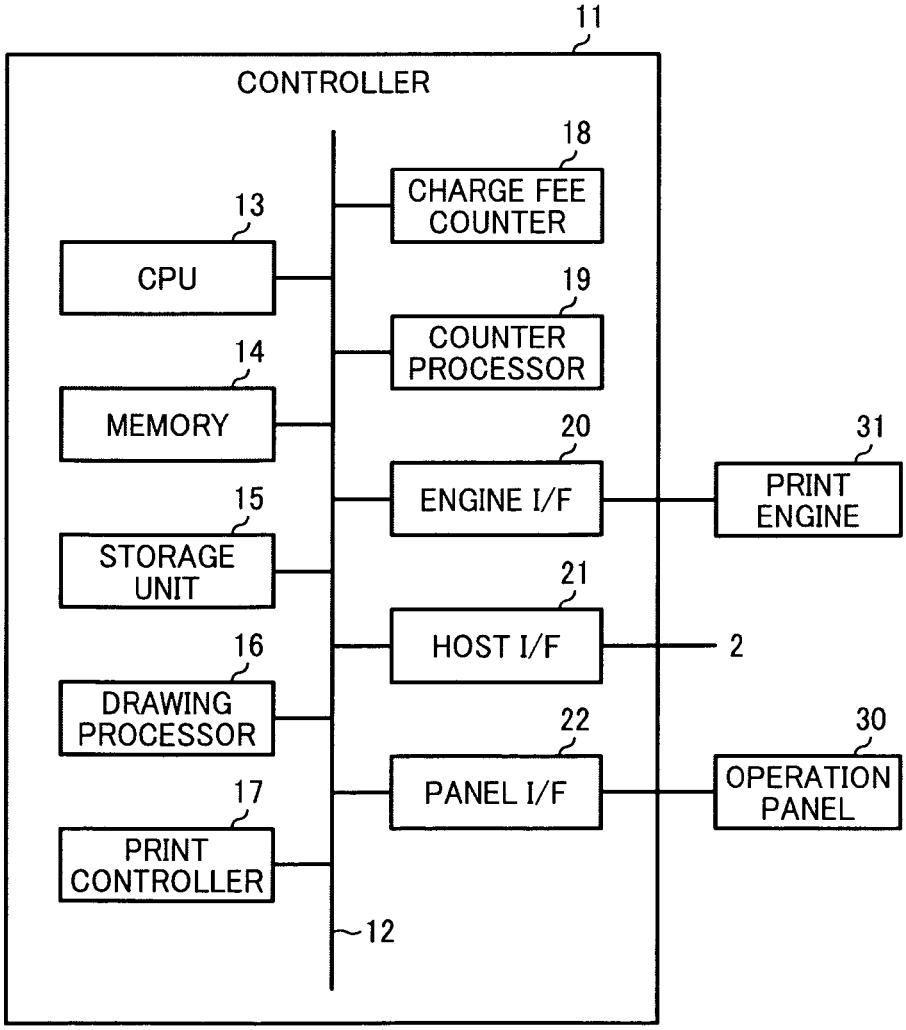
FIG. 2 is a schematic block diagram illustrating a structure of a controller of the image forming apparatus of FIG. 1.

The image forming apparatus 1 at least includes a controller 11 of FIG. 2 that controls operation of the image forming apparatus 1. In addition, the image forming apparatus 1 includes a print engine 31 that forms an image of print image data on a recording sheet, and an operation panel 30 that functions as a user interface for interaction with a user. The controller 11 of FIG. 2 includes a central processing unit (CPU) 13, a memory 14, a storage unit 15, a drawing processor 16, a print controller 17, a charge fee counter 18, a counter processor 19, an engine interface (I/F) 20, a host interface (I/F) 21, and a panel interface (I/F) 22, which are connected through a bus 12.

The CPU 13 controls operation of the image forming apparatus 1. For example, the CPU 13 processes print data including print image data and print control data, which is received from the host computer 3, according to a image processing control program stored in the ROM.

The memory 14 includes a program read only memory (ROM), a font ROM, and a random access memory (RAM). The program ROM stores therein the image processing control program that causes the controller 11 to manage data or control operation of peripheral modules to perform image processing operation. The font ROM stores therein various types of font available for printing. The RAM functions as a work memory for the CPU 13, an image buffer that temporarily stores data received from the host computer 3 on the page-by-page basis, or a bit-map memory that converts data stored in the buffer to printing patterns and stores as video data.

The storage unit 15 is implemented by a hard disk drive (HDD) capable of storing a large amount of data including, for example, image data processed by the image forming apparatus 1.

The drawing processor 16 converts the print image data to bit map data, and writes the bit map data onto the memory 14. Further, before storing the print image data, the drawing processor 16 performs color conversion on the print image data from RGB to CMYK. The drawing processor 16 further performs various image processing such as gamma correction and halftone processing on print image data such as the bit map data read out from the memory 14.

The print controller 17 sends the bit map data generated by the drawing processor 16 and the print control data received through the CPU 13 to the engine I/F 20, and instructs the print engine 31 to perform printing. In this example, the print control data indicates a number of pages or sheets to be printed, and a specific mode in which printing is to be performed that may be selected from a plurality of printing modes by default or according to a user instruction. Examples of printing mode include, but not limited to, a full-color printing mode, monochrome printing mode, two-color printing mode, and toner save printing mode ("toner save mode"). The full-color printing mode is a printing mode in which a document is printed in full-color using all of C, M, Y, and K toner. The monochrome printing mode is a printing mode in which a document is printed in monochrome using only K toner. The two-color printing mode is a printing mode in which only two colors selected from C, M, Y, and K are used for printing. The toner save mode is a printing mode in which less toner is used for printing. For the descriptive purposes, in this example, these printing modes are generally classified into three types of printing modes including the full-color printing mode, the monochrome printing mode, and an economical printing mode. In this example, the economical printing mode includes the two-color printing mode and the toner save mode. However, any other printing mode may be classified into the economical printing mode as long as the usage of toner required for printing is reduced either by reducing a number of colors of toner or an amount of toner being consumed.

The charge fee counter 18 counts a number of pages of document to be printed for each printing mode as a counter value, based on the result output from the CPU 13. More specifically, in this example, the charge fee counter 18 is provided with at least three internal counters including a color charge fee counter, a monochrome charge fee counter, and an economical (Eco) charge fee counter.

The counter processor 19 obtains a counter value indicating a number of pages of document to be printed for each printing mode that is counted by the charge fee counter 18, performs calculation on the obtained counter value, and sends the calculated result to the operation panel I/F 22. Based on the calculated result of the counter processor 19, the CPU 13 may further calculate a charge fee for printing a document in a specific printing mode, using either one of a unit charge fee previously set for full-color printing and a unit charge fee previously set for monochrome printing.

More specifically, in this example, the functions respectively performed by the charge fee counter 18 and the counter processor 19 are performed under control of the CPU 13, upon loading a charge fee management program that may be stored in a desired memory such as the ROM of the memory 14. Upon execution of the CPU 13, the CPU 13 loads the charge fee management program stored in the ROM of the memory 14 onto the RAM of the memory 14 to cause the CPU 13 to function as the charge fee counter 18 and the counter processor 19. Alternatively, the charge fee management program may be stored in any desired removable medium or any storage device provided on the network 2 for distribution.

Still referring to FIG. 2, the engine I/F 20 functions as an interface between the controller 11 and the print engine 31. For example, the engine I/F 20 sends a control signal used for controlling the print engine 31 to the print engine 31, or receives a status signal indicating the status of the print engine 31 from the print engine 31.

The host I/F 21 functions as an interface between the image forming apparatus 1 and the host computer 3. For example, the host I/F 21 receives print data sent from the host computer 3 through the network 2, or sends a status signal indicating the status of the image forming apparatus 1 to the host computer 3 through the network 2.

The panel I/F 22 functions as an interface between the controller 11 and the operation panel 30. For example, the panel I/F 22 sends a signal that indicates the status of the image forming apparatus 1, a current mode of the image forming apparatus 1, or a font to be used by the image forming apparatus 1, which may be used to generate a screen to be displayed on the operational panel 30. In this example, the operation panel 30 is provided with a display such as a liquid crystal display (LCD) for displaying various information to the user at the image forming apparatus 1, and various keys or buttons that allow the user to input a user instruction. Additionally or alternatively, the operation panel 30 may be implemented by a display functioning as a touch panel screen.

Figure 3:
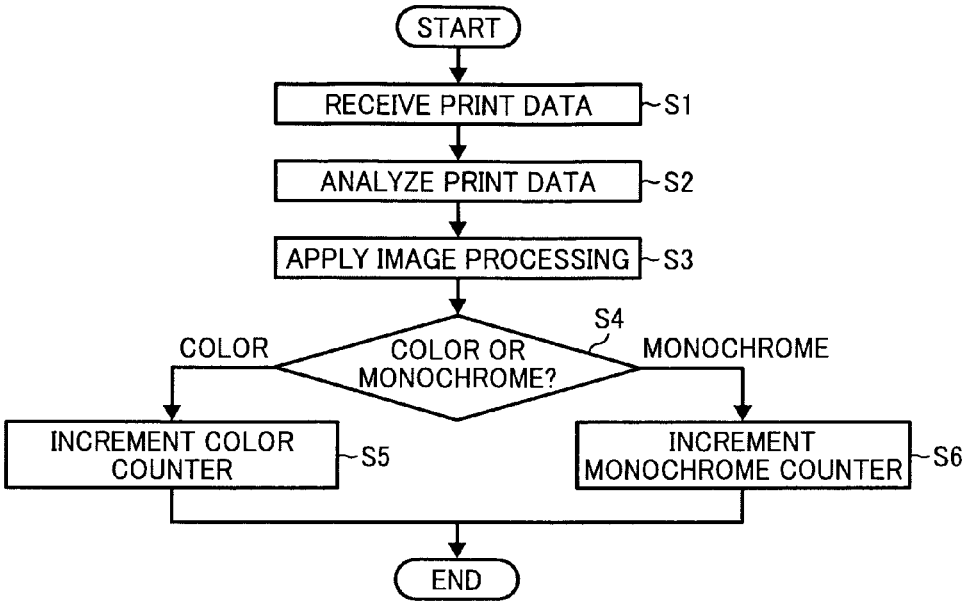
FIG. 3 is a flowchart illustrating operation of counting a number of pages of document printed using the image forming apparatus of FIG. 1, performed by the image forming apparatus of FIG. 1, according to an example embodiment of the present invention.

Referring to FIG. 3, operation of counting a number of pages of document that are printed using the image forming apparatus 1, performed by the image forming apparatus 1 under control of controller 11, is explained according to an example embodiment of the present invention.

At S1, the host I/F 21 receives print data from the host computer 3 through the network 2, and sends the print data to the CPU 13.

At S2, the CPU 13 analyzes the print data received from the host I/F 21 to divide the print data into print image data and print control data.

At S3, the drawing processor 16 converts the print image data to bit map data, and applies image processing to the bit map data.

At S4, the CPU 13 determines whether the print image data is to be printed in color or monochrome to generate a determination result. When the determination result indicates that the print image data is to be printed in color ("COLOR" at S4), the operation proceeds to S5. When the determination result indicates that the print image data is to be printed in monochrome ("MONOCHROME" at S4), the operation proceeds to S6. The CPU 13 may determine whether the print image data is to be printed in color or monochrome according to the print control data obtained at S2. Alternatively, the CPU 13 may determine whether the print image data is to be printed in color or monochrome according to a type of print image data to be printed such as whether the print image data is color or monochrome.

At S5, the charge fee counter 18 increments the counter value of the color charge fee counter by a predetermined number, and the operation ends. At S6, the charge fee counter 18 increments the counter value of the monochrome charge fee counter by a predetermined number, and the operation ends. Specifically, in this example, the number for incrementing the charge fee counter 18 is determined based on a number of pages or sheet to be printed, which may be obtainable from the print control data.

Figure 4:
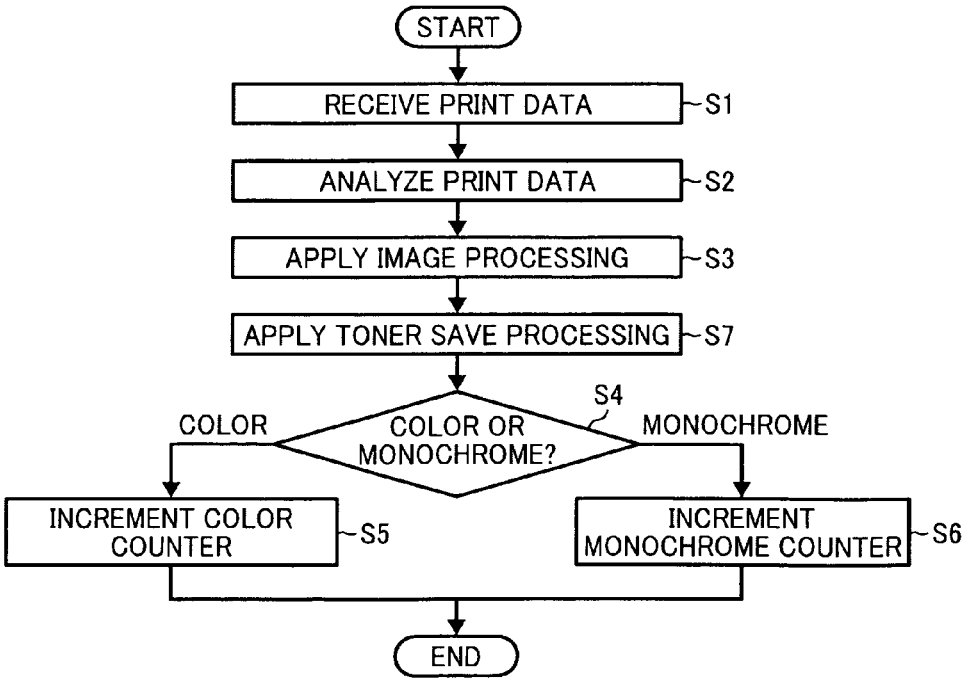
FIG. 4 is a flowchart illustrating operation of counting a number of pages of document printed in a toner save mode using the image forming apparatus of FIG. 1, performed by the image forming apparatus of FIG. 1, according to an example embodiment of the present invention.

Referring to FIG. 4, operation of counting a number of pages of document that are printed by the image forming apparatus 1, performed by the image forming apparatus 1, is explained according to an example embodiment of the present invention. The operation of FIG. 4 is substantially similar to the operation of FIG. 3, except for the addition of S7.

More specifically, in this example, at S2, when the CPU 13 determines that the print control data instructs that the print image data is to be processed in the toner save mode, S7 is additionally performed between S3 and S4. At S7, the drawing processor 16 applies toner save processing to adjust color of the print image data so as to reduce the total amount of toner to be used for image forming.

For example, the user at the host computer 3 may instruct the image forming apparatus 1 to print a document in the toner save mode by selecting the toner save mode through a settings screen such as property dialog being displayed by a display of the host computer 3. The host computer 3 generates print control data that indicates selection of the toner save mode, and sends the print control data to the image forming apparatus 1. At this time, the user may set a specific value of toner save rate indicating the amount of toner usage in toner save mode compared with the amount of toner usage in full-color printing /mode or monochrome printing mode. Alternatively, the toner save rate may be set by default.

When the image forming apparatus 1 determines that the document is to be printed in the toner save mode according to the print control data, the drawing processor 16 applies toner save processing to the print image data, specifically, by reducing overall toner density of the print image data. For example, the drawing processor 16 converts a pixel value of the print image data using the equation: PV2=PV1*(100−sv)/100, wherein PV2 is a pixel value of print image data after toner save processing is applied, PV1 is an original pixel value of print image data, and sv is a toner save rate expressed in percentage. In alternative to calculating using the equation, the drawing processor 16 may convert a pixel value of the print image data using a toner save table that stores the processed pixel values of print image data in association with the unprocessed pixel values of print image data.

Alternatively, the drawing processor 16 may convert a pixel value of the print image data to reduce overall toner density of the print image data, by performing gamma correction using a gamma table prepared for toner save mode in alternative to using a gamma table that is usually used. The toner save gamma table may be generated by multiplying the normal table with a predetermined coefficient, which is less than 1.

Figure 5:
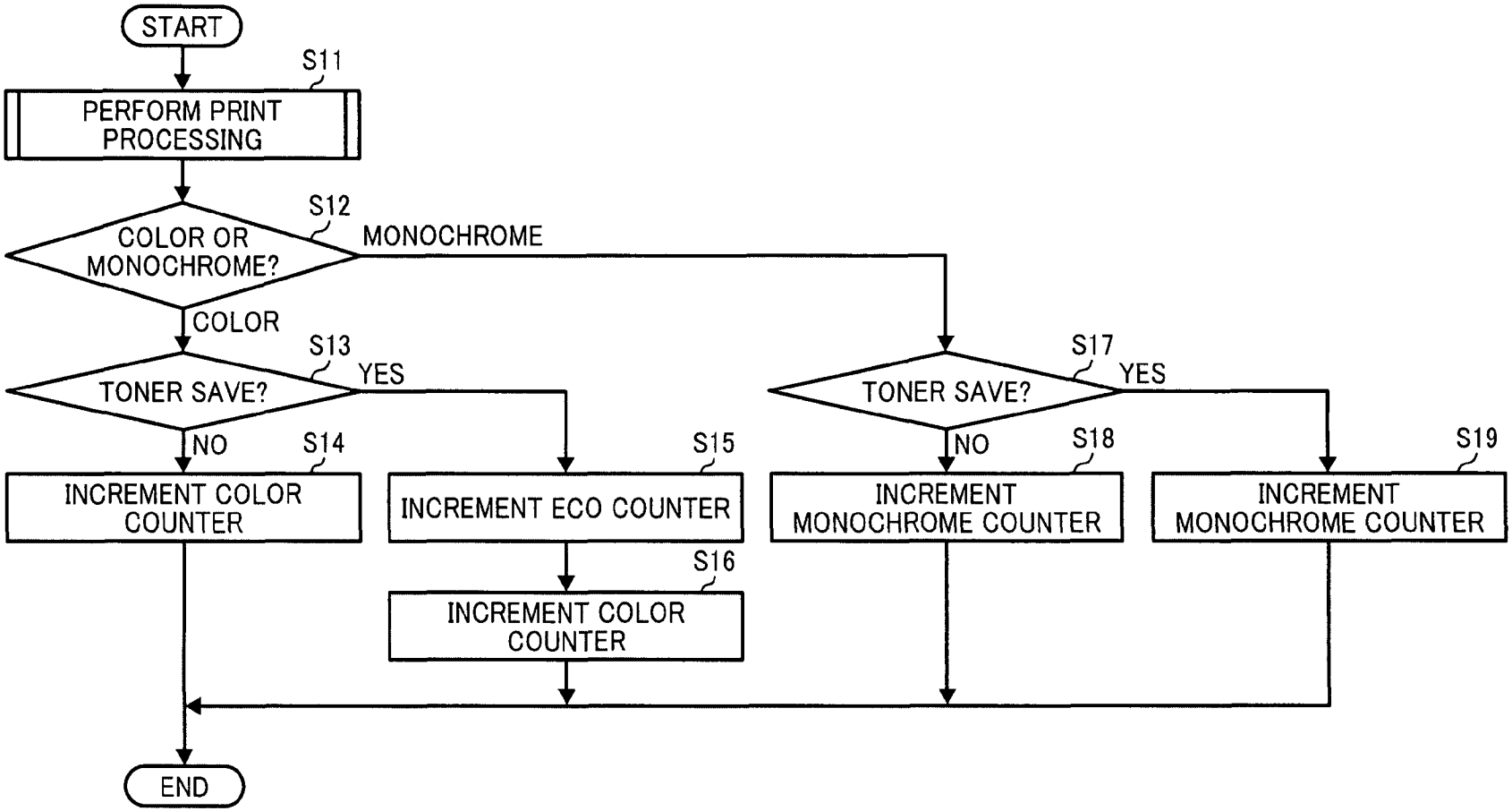
FIG. 5 is a flowchart illustrating operation of counting a number of pages of document printed in various printing modes using the image forming apparatus of FIG. 1, performed by the image forming apparatus of FIG. 1, according to an example embodiment of the present invention.

Referring now to FIG. 5, operation of counting a number of pages of document that are printed by the image forming apparatus 1, performed by the image forming apparatus 1 under control of controller 11, is explained according to an example embodiment of the present invention.

At S11, the controller 11 performs printing operation, which includes S1 to S3 of FIG. 3. More specifically, the host I/F 21 receives print data from the host computer 3 through the network 2, and sends the print data to the CPU 13. The CPU 13 analyzes the print data received from the host I/F 21 to divide the print data into print image data and print control data. The drawing processor 16 converts the print image data to bit map data, and applies image processing to the bit map data.

At S12, the CPU 13 determines whether the print image data is to be printed in color or monochrome to generate a determination result, in a substantially similar manner as described above referring to S4 of FIG. 3.

When the determination result indicates that the print image data is printed in color ("COLOR" at S12), the operation proceeds to S13.

At S13, the CPU 13 determines whether the print control data instructs to print the print image data in the toner save mode. When it is determined that the toner save mode is set ("YES" at S13), the operation proceeds to S15. When it is determined that the toner save mode is not set ("NO" at S13), the operation proceeds to S14.

At S14, the charge fee counter 18 increments the counter value of the color charge fee counter by a predetermined number, and the operation ends. The charge fee counter 18 increments the Eco charge fee counter by a predetermined number at S15, and further increments the counter value of the color charge fee counter by a predetermined number at S16, and the operation ends.

When the determination result indicates that the print image data is printed in monochrome ("MONOCHROME" at S12), the operation proceeds to S17.

At S17, the CPU 13 determines whether the print control data instructs to print the print image data in the toner save mode. When it is determined that the toner save mode is set ("YES" at S17), the operation proceeds to S19. When it is determined that the toner save mode is not set ("NO" at S17), the operation proceeds to S18.

At S18, the charge fee counter 18 increments the counter value of the monochrome charge fee counter by a predetermined number, and the operation ends. At S19, the charge fee counter 18 increments the monochrome charge fee counter by a predetermined number, and the operation ends.

In any one of the above-described examples, the controller 11 selects at least one of the counters of the charge fee counter 18 used for counting a number of pages of document, according to a specific printing mode. In order to determine at least one of the counters of the charge fee counter 18 for use, the image forming apparatus 1 is provided with a counter value table of FIG. 6 that indicates a specific counter of the charge fee counter 18 to be selected for a specific printing mode as well as a specific number of counter values to be incremented.

Referring to FIG. 6, the counter value table stores print settings information regarding specific print settings set by the host computer 3 according to a user instruction. More specifically, the print settings information includes a "PRINT COLOR MODE" field storing information that indicates whether the printing mode is set to full-color printing mode or monochrome printing mode, a "TONER SAVE MODE" field storing information that indicates whether the toner save mode is set to on or off, and an "ORIGINAL" field storing information that indicates whether the original image to be processed is color or monochrome.

In this example, when the print color mode is set to full-color printing mode, the image data is to be printed using all colors of colorant, such as toner or ink of all colors including black color. Accordingly, even when the original image to be printed is monochrome, all colors are used to print the original image data in color mode. When the print color mode is set to monochrome printing mode, only a black colorant is used. Accordingly, even when the original image data to be printed is color, only black color is used to print the original image data in monochrome printing mode.

The counter value table of FIG. 6 further includes charge fee counter information regarding a counter value of each of the color charge fee counter, monochrome charge fee counter, and the Eco charge fee counter, which is to be incremented as printing is performed for printing one page of document according to the print settings information.

Still referring to FIG. 6, when the print settings information indicates that the image data is to be printed in full-color printing mode and toner save mode, the charge fee counter 18 increments the color charge fee counter by one and the Eco charge fee counter by one when the image data is color, and the charge fee counter 18 increments the monochrome charge fee counter by one when the image data is monochrome.

When the print settings information indicates that the image data is to be printed in full-color printing mode but not in toner save mode, the charge fee counter 18 increments the color charge fee counter by one when the image data is color, and the charge fee counter 18 increments the monochrome charge fee counter by one when the image data is monochrome.

When the print settings information indicates that the image data is to be printed in monochrome printing mode, the charge fee counter 18 increments the monochrome charge fee counter by one in spite of whether the image data is color or monochrome. When the monochrome printing mode is selected, the user is not allowed to turn on the toner save mode.

For the descriptive purposes, FIG. 7 illustrates the counter values obtained by the charge fee counter 18 when the image forming apparatus 1 prints one set of 10 sheets of original image data, respectively, in full-color printing mode, monochrome printing mode, and full-color printing and toner save modes. The image forming apparatus 1 stores a table of FIG. 7 in the memory 14 such that an accumulated number of counter values obtained respectively for the color charge fee counter, monochrome charge fee counter, and Eco charge fee counter are retained for later use.

Referring to FIG. 8, operation of displaying the counter values counted by the charge fee counter 18 under control of the controller 11, performed by the image forming apparatus 1, is explained according to an example embodiment of the present invention. The operation of FIG. 8 is performed at any desired time after operation of any one of FIGS. 3, 4, and 5.

At S21, the CPU 13 obtains the counter values counted by the charge fee counter 18, such as the counter values of the color charge fee counter, the monochrome charge fee counter, and the Eco charge fee counter. Further, if needed, the CPU 13 causes the counter processor 19 to adjust the counter values of the charge fee counter 18.

At S22, the CPU 13 sends the obtained counter values of the charge fee counter 18, which may be adjusted by the counter processor 19, to the panel I/F 22, and causes the operation panel 30 to display information based on the obtained counter values through the panel I/F 22.

While the charge fee counter 18 is provided with three internal counters including the color charge fee counter, monochrome charge fee counter, and Eco charge fee counter, the image forming apparatus 1 is previously set such that the counter processor 19 calculates a charge fee for printing based on a unit charge fee that is set for color printing or monochrome printing. Accordingly, the counter processor 19 converts the counter value of the Eco charge fee counter that is obtained for economical printing to a counter value of either one of the color charge fee counter and the monochrome charge fee counter. With this conversion, the counter processor 19 is able to calculate a charge fee for printing a document in the economical printing mode even when there is no unit charge fee specifically set for economical printing.

Figure 9:
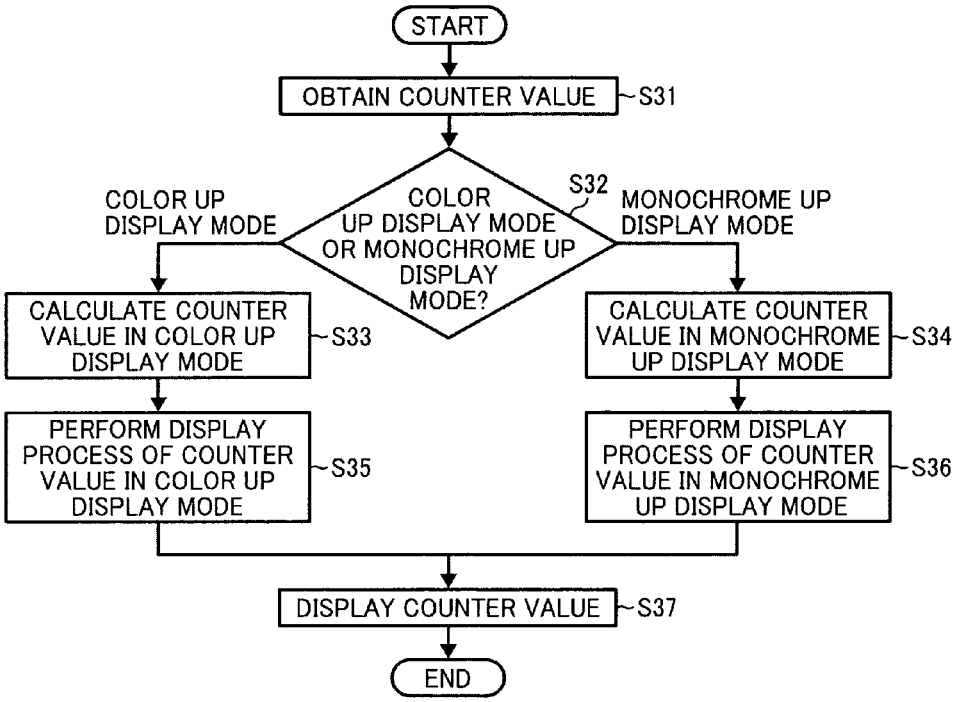
FIG. 9 is a flowchart illustrating operation of calculating a number of pages of document to be used for charge fee determination based on a counter value obtained by performing the operation of FIG. 5, performed by the image forming apparatus of FIG. 1.

Referring now to FIG. 9, operation of calculating a counter value of the charge fee counter 18 under control of the controller 11, performed by the image forming apparatus 1, is explained according to an example embodiment of the present invention. In this example, the controller 11 multiplies the counter value of Eco charge fee counter with a predetermined coefficient called a weighting factor, and adds the weighted Eco counter value to the counter value of the monochrome charge fee counter or subtracts the weighted Eco counter value from the counter value of the color charge fee counter.

At S31, the CPU 13 obtains the counter values of the charge fee counter 18 including the counter value of the color charge fee counter, the counter value of the monochrome charge fee counter, and the counter value of the Eco charge fee counter, for example, from the table of FIG. 7.

Figure 10:
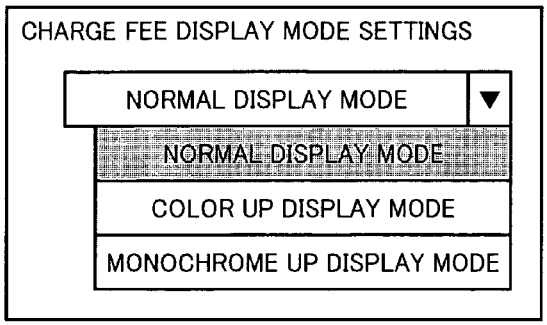
FIG. 10 is an illustration of an example charge fee display mode settings screen, displayed by the image forming apparatus of FIG. 1.

At S32, the CPU 13 determines whether a charge fee display mode is set to a color up display mode or a monochrome up display mode. In this example, the charge fee display mode is previously set by the user through the operation panel 30 or through the host computer 3. For example, the operation panel 30 or the host computer 3 displays a settings screen illustrated in FIG. 10 on its display, and allows the user to select one of the display modes. The panel I/F 22 or the host I/F 21 stores information regarding the selected one of the display modes in the memory 14. When the normal counter mode is selected, the controller 11 causes the operation panel 30 or the host computer 3 to display the counter value of the color charge fee counter and the counter value of the monochrome charge fee counter, respectively, without adjusting with the counter value of Eco charge fee counter. In case of table of FIG. 7, the operation panel 30 or the host computer 3 displays the counter value of 20 for the color charge fee counter, and the counter value of 10 for the monochrome charge fee counter. Based on these counter values, the image forming apparatus 1 may further calculate a charge fee of the image forming apparatus 1 using a unit charge fee for color printing or monochrome printing.

Referring back to FIG. 9, when it is determined that the display mode is set to the color up display mode ("COLOR" at S32), the operation proceeds to S33 to calculate a weighted counter value of the Eco charge fee counter for the color up display mode, and to S35 to obtain a counter value of the color charge fee counter based on the weighted counter value of the Eco charge fee counter obtained at S33.

When it is determined that the display mode is set to the monochrome up display mode ("MONOCHROME" at S32), the operation proceeds to S34 to obtain a weighted counter value of the Eco charge fee counter for the monochrome up display mode, and to S36 to obtain a counter value of the monochrome charge fee counter based on the weighted counter value of the Eco charge fee counter obtained at S34.

At S37, the CPU 13 causes the operation panel 30 or the host computer 3 to display the counter value of the charge fee counter 18, in selected one of the color up display mode and the monochrome up display mode, and the operation ends.

In this example, S33 to S36 are performed according to information obtained from a charge fee display mode table of FIG. 11. Referring to FIG. 11, the charge fee display mode table of FIG. 11 stores, for each of a plurality of charge fee display modes available for the image forming apparatus 1, information indicating calculation of the counter value for each of the color charge fee counter and the monochrome charge fee counter of the charge fee counter 18.

More specifically, the charge fee display mode table of FIG. 11 includes a "CHARGE FEE COUNTER DISPLAY MODE" field that indicates a plurality of display mode types that are available for use. In this example, as described above referring to FIG. 10, the color up display mode, the monochrome up display mode, and the normal display mode are available for selection by the user. The charge fee display mode table of FIG. 11 further includes a "COLOR COUNTER" field that stores information indicating how the counter value of the color charge fee counter of the charge fee counter 18 is calculated for each of the display modes. The charge fee display mode table of FIG. 11 further includes a "MONOCHROME COUNTER" field that stores information indicating how the counter value of the monochrome charge fee counter of the charge fee counter 18 is calculated for each of the display modes.

Referring to FIG. 9 and FIG. 11, example operation of obtaining the counter values of the charge fee counter 18 is explained, with the emphasis on example case of printing a document in toner save mode.

Assuming that the display mode is set to the color up display mode ("COLOR" at S32), at S33, the CPU 13 obtains a counter value of the Eco charge fee counter from the memory 14, and multiplies the obtained counter value of the Eco charge fee counter with a weighing factor of 0.5 to generate a weighted counter value of the Eco charge fee counter. At S35, the CPU 13 subtracts the weighted counter value of the Eco charge fee counter, from a current counter value of the color charge fee counter obtained from the memory 14, to obtain a counter value of the color charge fee counter for display in the color up display mode. The CPU 13 further obtains a current counter value of the monochrome charge fee counter from the memory 14 for display. When the calculated counter value is not integer, the decimal points are ignored. Further, in this example, the value of weighing factor is previously determined, for example, according to a user instruction input through the operation panel 30 or the host computer 3. Alternatively, the value of weighting factor may be previously set by default. The value of the weighting factor may be stored in the memory 14.

Assuming that the display mode is set to the monochrome up display mode ("MONOCHROME" at S32), at S34, the CPU 13 obtains a counter value of the Eco charge fee counter from the memory 14, and multiplies the obtained counter value of the Eco charge fee counter with a weighing factor of 1.0 to generate a weighted counter value of the Eco charge fee counter. At S36, the CPU 13 subtracts the weighted counter value of the Eco charge fee counter, from a current counter value of the color charge fee counter obtained from the memory 14, to obtain a counter value of the color charge fee counter for display in the monochrome up display mode. Further, at S36, the CPU 13 obtains a current counter value of the monochrome charge fee counter from the memory 14, and adds the weighted counter value of the Eco charge fee counter to the current counter value of the monochrome charge fee counter to obtain a counter value of the monochrome charge fee counter for display in the monochrome up display mode.

For the descriptive purposes, FIG. 12 illustrates the counter values obtained by the counter processor 19 for each of the display modes stored in the table of FIG. 11, when the image forming apparatus 1 prints one set of 10 sheets of original image data, respectively, in full-color printing mode, monochrome printing mode, and full-color printing and toner save modes as described above referring to FIG. 7.

When the display mode is set to the color up display mode, the counter value of the monochrome charge fee counter is 10, which is the same counter value obtained for the monochrome counter in the normal display mode. The counter value of the color charge fee counter is 15, which can be obtained using the equation: 20−10*0.5, with 20 being the counter value of the color charge fee counter, 10 being the counter value of the Eco charge fee counter, and 0.5 being the weighting factor previously set for the color up display mode.

When the display mode is set to the monochrome up display mode, the counter value of the monochrome charge fee counter is 20, which is obtained using the equation: 10+10*1, with the first 10 being the counter value of the monochrome charge fee counter, the second 10 being the counter value of the Eco charge fee counter, and 1 being the weighting factor previously set for the monochrome up display mode. The counter value of the color charge fee counter is 10, which is obtained using the equation: 20−10*1, with 20 being the counter value of the color charge fee counter, 10 being the counter value of the Eco charge fee counter, and 1 being the weighting factor previously set for the monochrome up display mode.

When the display mode is set to the normal display mode, the counter value of the monochrome charge fee counter and the counter value of the color charge fee counter are 10 and 20, respectively, which are obtained based on a number of sheets that are printed as described above referring to FIG. 7.

As described above referring to FIGS. 9 and 11, the counter processor 19 adjusts the counter values of the charge fee counter 18 for the color up display mode or the monochrome up display mode, by adding or subtracting the weighted Eco counter value to or from at least one of the color charge fee counter value and the monochrome charge fee counter value. Since the counter value of the color charge fee counter and the counter value of the monochrome charge fee counter are respectively retained in the memory 14, for example, in the form of table of FIG. 7, these counter values are kept the same even when the display mode is switched from one to another.

As described above, the image forming apparatus 1 is provided with a function of adjusting a counter value of the Eco charge fee counter of the charge fee counter 18 that corresponds to economical printing. More specifically, in case of printing a document in full-color printing and toner save modes with the selection of color up display mode, the counter values of the color charge fee counter and the counter value of the Eco charge fee counter are respectively incremented. The counter value of the Eco charge fee counter is multiplied with a weighing factor to generate a weighted counter value of the Eco charge fee counter. The image forming apparatus 1 subtracts the weighted counter value of the Eco charge fee counter from the counter value of the color charge fee counter for display in color up display mode using the color charge fee counter. Further, the image forming apparatus 1 may obtain the counter value of the monochrome charge fee counter for display in color up display mode using the monochrome charge fee counter. In this manner, the image forming apparatus 1 is able to obtain and display information regarding a charge fee for printing a document in toner save mode, using the color charge fee counter and the monochrome charge fee counter without requiring any additional counter.

Alternatively, in case of printing a document in full-color printing and toner save modes with the selection of monochrome up display mode, the counter values of the color charge fee counter and the counter value of the Eco charge fee counter are respectively incremented. The counter value of the Eco charge fee counter is multiplied with a weighting factor to generate a weighted counter value of the Eco charge fee counter. The image forming apparatus 1 subtracts the weighted counter value of the Eco charge fee counter from the counter value of the color charge fee counter for display in monochrome up display mode using the color charge fee counter. Further, the image forming apparatus 1 adds the weighted counter value of the Eco charge fee counter to the counter value of the monochrome charge fee counter for display in monochrome up display mode using the monochrome charge fee counter. In this manner, the image forming apparatus 1 is able to obtain and display information regarding a charge fee for printing a document in toner save mode, using the color charge fee counter and the monochrome charge fee counter without requiring any additional counter.

Further, as described above throughout the specification, the charge fee counter 18 and the counter processor 19 are provided within the image forming apparatus 1 such that a management server does not have to be provided on the network 2 to perform charge fee calculation. Further, since the image forming apparatus is able to perform charge fee calculation without any access to the network 2, the image forming apparatus that is not capable of communicating via network may be used in alternative to the image forming apparatus 1 of FIG. 1. In such case, however, it is assumed that the image forming apparatus 1 copies a document according to a user instruction received from the operation panel 30, or prints print image data obtained from its internally memory such as the storage unit 15.

More specifically, by installing the charge fee management program that additionally adds the charge fee counter 18 and the counter processor 19 onto any desired image forming apparatus, the image forming apparatus installed with such management program is able to calculate a charge fee for economical printing with improved accuracy, even only when a unit charge fee for full-color printing or a unit charge fee for monochrome printing is available. Further, in any one of the above-described examples, the example case of using the toner save mode as the economical printing is described. Additionally or alternatively, any other printing mode may be used for economical printing such as a two color printing mode in which a limited number of colors of toner is used for printing.

Further, in the above-described example, it is assumed that the image forming apparatus forms an image using toner. Alternatively, any other type of colorant may be used to form an image such as ink.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the spirit and scope of the present invention, and all such modifications are intended to be included within the scope of the present invention.

For example, elements and/or features of different illustrative embodiments may be combined with each other and/or substituted for each other within the scope of this disclosure and appended claims.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, involatile memory cards, ROM (read-only-memory), etc.

Alternatively, any one of the above-described and other methods of the present invention may be implemented by ASIC, prepared by interconnecting an appropriate network of conventional component circuits or by a combination thereof with one or more conventional general purpose microprocessors and/or signal processors programmed accordingly.

In one example, the present invention may reside in an image forming apparatus capable of printing a document in various printing modes including a full-color printing mode, monochrome printing mode, and other printing mode. The image forming apparatus is previously set with a unit charge fee for printing a document in the full-color printing mode and a unit charge fee for printing a document in the monochrome printing mode. The image forming apparatus includes: means for counting a number of sheets of document printed in the full-color printing mode; means for counting a number of sheets of document printed in the monochrome printing mode; and means for counting a number of sheets of document printed in the other printing mode. The image forming apparatus further includes: means for multiplying a weighting factor to a counter value of the other printing mode counting means to obtain a weighted counter value; and means for subtracting the weighted counter value of the other printing mode counting means from the counter value of the full-color printing mode counting means or adding the weighted counter value of the other printing mode counting means to the counter value of the monochrome printing mode counting means to obtain a counter value used for charge fee determination. The other printing mode is a printing mode in which a number of colors of colorant used for printing is less than a number of colors of colorant used for full-color printing or an amount of colorant used for printing is less than an amount of colorant used for full-color printing.

In the above-described example, the image forming apparatus further includes: means for setting the weighing factor according to a user instruction.

In the above-described example, the image forming apparatus further includes: means for selecting whether to subtract the weighted counter value of the other printing mode counting means from the counter value of the full-color printing mode counting means or add the weighted counter value of the other printing mode counting means to the counter value of the monochrome printing mode counting means, according to a user instruction.

In the above-described example, the image forming apparatus further includes means for displaying the counter value of the full-color printing mode counting means; and means for displaying the counter value of the monochrome printing mode counting means.

In another example, the present invention may reside in a method of managing a charge fee of an image forming apparatus capable of printing a document in various printing modes including a full-color printing mode, monochrome printing mode, and other printing mode. The image forming apparatus is previously set with a unit charge fee for printing a document in the full-color printing mode and a unit charge fee for printing a document in the monochrome printing mode. The charge fee managing method includes: counting a number of sheets of document printed in the full-color printing mode; counting a number of sheets of document printed in the monochrome printing mode; counting a number of sheets of document printed in the other printing mode; multiplying a weighting factor to a counter value of the other printing mode counting step to obtain a weighted counter value; subtracting the weighted counter value from the counter value of the full-color printing mode counting step or adding the weighted counter value to the counter value of the monochrome printing mode counting step to obtain a counter value used for charge fee determination. The other printing mode is a printing mode in which a number of colors of colorant used for printing is less than a number of colors of colorant used for full-color printing or an amount of colorant used for printing is less than an amount of colorant used for full-color printing.

In another example, the present invention may reside in a recording medium storing a plurality of instructions which cause a computer to perform the above-described charge fee managing method.

What is claimed is:

1. An image forming apparatus, comprising:

a charge fee counter unit including:

a color counter configured to count a number of sheets to be printed in a full-color printing mode to generate a first counter value;

a monochrome counter configured to count a number of sheets to be printed in a monochrome printing mode to generate a second counter value; and an economical counter configured to count a number of sheets to be printed in an economical printing mode to generate a third counter value, wherein the economical printing mode causes the image forming apparatus to form an image with colorant having a number of colors that is less than a number of colors used for the full-color printing mode or with colorant having an amount less than an amount of colorant used for a printing mode in which the economical printing mode is not set; and a counter processor configured to obtain selected one of: a total counter value of the color counter based on the first counter value and the third counter value; and a total counter value of the monochrome counter based on the second counter value and the third counter value, wherein the counter processor obtains the total counter value of the color counter by multiplying the third counter value with a weighting factor to generate a weighted third counter value and subtracting the weighted third counter value from the first counter value, the total counter value of the color counter being used for determination of a charge fee of the image forming apparatus based on a unit charge fee previously set for the full-color printing mode, and the counter processor obtains the total counter value of the monochrome counter by multiplying the third counter value with a weighting factor to generate a weighted third counter value and adding the weighted third counter value to the second counter value, the total counter value of the monochrome counter being used for determination of a charge fee of the image forming apparatus based on a unit charge fee previously set for the monochrome printing mode.

2. The image forming apparatus of claim 1, further comprising:

an interface unit configured to receive a user instruction input by a user, wherein a value of the weighting factor is determined according to the user instruction.

3. The image forming apparatus of claim 1, further comprising:

an interface unit configured to receive a user instruction input by a user, wherein the counter processor determines whether to obtain the total counter value of the color counter or the total counter value of the monochrome counter according to the user instruction.

4. The image forming apparatus of claim 1, further comprising:

a display unit configured to display at least one of the total counter value of the color counter and the total counter value of the monochrome counter.

5. A method of managing a charge fee of an image forming apparatus, the method comprising:

counting a number of sheets to be printed in a full-color printing mode using a color counter to generate a first counter value;

counting a number of sheets to be printed in a monochrome printing mode using a monochrome counter to generate a second counter value;

counting a number of sheets to be printed in an economical printing mode to generate a third counter value, wherein the economical printing mode causes the image forming apparatus to form an image with colorant having a number of colors that is less than a number of colors used for the full-color printing mode or with colorant having an amount less than an amount of colorant used for a printing mode in which the economical printing mode is not set;

obtaining selected one of: a total counter value of the color counter based on the first counter value and the third counter value; and a total counter value of the monochrome counter based on the second counter value and the third counter value, wherein the total counter value of the color counter is obtained by multiplying the third counter value with a weighting factor to generate a weighted third counter value and subtracting the weighted third counter value from the first counter value, the total counter value of the color counter being used for determination of a charge fee of the image forming apparatus based on a unit charge fee previously set for the full-color printing mode, and the total counter value of the monochrome counter is obtained by multiplying the third counter value with a weighting factor to generate a weighted third counter value and adding the weighted third counter value to the second counter value, the total counter value of the monochrome counter being used for determination of a charge fee of the image forming apparatus based on a unit charge fee previously set for the monochrome printing mode.

6. The method of claim 5, further comprising:

receiving a user instruction input by a user; and determining a value of the weighting factor according to the user instruction.

7. The method of claim 5, further comprising:

receiving a user instruction input by a user; and determining whether to obtain the total counter value of the color counter or the total counter value of the monochrome counter according to the user instruction.

8. The method of claim 5, further comprising:

displaying at least one of the total counter value of the color counter and the total counter value of the monochrome counter.

9. A non-transitory recording medium storing a plurality of instructions which cause a processor, when executed, to perform a method of managing a charge fee of an image forming apparatus, the method comprising:

counting a number of sheets to be printed in a full-color printing mode using a color counter to generate a first counter value;

counting a number of sheets to be printed in a monochrome printing mode using a monochrome counter to generate a second counter value;

counting a number of sheets to be printed in an economical printing mode to generate a third counter value, wherein the economical printing mode causes the image forming apparatus to form an image with colorant having a number of colors that is less than a number of colors used for the full-color printing mode or with colorant having an amount less than an amount of colorant used for a printing mode in which the economical printing mode is not set;

obtaining selected one of: a total counter value of the color counter based on the first counter value and the third counter value; and a total counter value of the monochrome counter based on the second counter value and the third counter value, wherein the total counter value of the color counter is obtained by multiplying the third counter value with a weighting factor to generate a weighted third counter value and subtracting the weighted third counter value from the first counter value, the total counter value of the color counter being used for determination of a charge fee of the image forming apparatus based on a unit charge fee previously set for the full-color printing mode, and the total counter value of the monochrome counter is obtained by multiplying the third counter value with a weighting factor to generate a weighted third counter value and adding the weighted third counter value to the second counter value, the total counter value of the monochrome counter being used for determination of a charge fee of the image forming apparatus based on a unit charge fee previously set for the monochrome printing mode.

* * * * *